United States Patent [19]

Maier et al.

[11] Patent Number: 4,713,637

[45] Date of Patent: Dec. 15, 1987

[54] STORED ENERGY CIRCUIT BREAKER WITH RATCHET MECHANISM FOR CHARGING A CONTACT CLOSING SPRING

[75] Inventors: Alfred E. Maier, Chippewa, Pa.; David A. Leone, Lawrenceville, Ga.; Louis N. Ricci, Chippewa Township, Beaver County, Pa.

[73] Assignee: Westinghouse Electric Corp., Pittsburgh, Pa.

[21] Appl. No.: 913,880

[22] Filed: Sep. 30, 1986

[51] Int. Cl.[4] ..... H01H 3/00; H01H 9/00; H01H 51/00

[52] U.S. Cl. ..... 335/76; 335/185; 200/153 SC

[58] Field of Search ..... 335/185, 76, 171; 200/153 SC, 288, 325, 153 G; 74/625

[56] References Cited

U.S. PATENT DOCUMENTS 4,095,676 6/1978 Howe et al. ..... 200/153 SC
4,491,709 1/1985 Chabot et al. ..... 200/153 SC

*Primary Examiner*—Clifford C. Shaw
*Assistant Examiner*—Lincoln Donovan
*Attorney, Agent, or Firm*—L. P. Johns

[57] ABSTRACT

A circuit breaker characterized by a ratchet mechanism for manual or electrical charging system and comprising a pair of separable contacts coupled with a rechargeable spring to close the contacts. The spring is indirectly connected to a drive shaft on which a ratchet wheel is fixedly mounted for rotation of the shaft in one direction. A drive wheel is rotatably mounted on the shaft for rotating the ratchet wheel and a brake wheel is mounted on the shaft for preventing rotation of the shaft in the other direction. Rotating means are provided for rotating the drive shaft.

4 Claims, 11 Drawing Figures

STORED ENERGY CIRCUIT BREAKER WITH RATCHET MECHANISM FOR CHARGING A CONTACT CLOSING SPRING

BACKGROUND OF THE INVENTION

1. Field of the Invention:

This invention relates to single or multi-pole circuit breakers and, more particularly, it pertains to a stored energy circuit breaker having a ratchet mechanism for charging a stored energy spring.

2. Description of the Prior Art:

The primary function of a circuit breaker is to interrupt the flow of current when abnormalities occur in an electric system. Abnormalities include current conditions such as short circuits.

Certain types of circuit breakers are provided with spring means for closing circuit breaker contacts. In the past, the springs have been charged by a ratchet wheel fixedly mounted on a spring-charging shaft. For example, in U.S. Pat. No. 3,254,186, a ratchet wheel is mounted on a crankshaft for charging springs for closing the circuit breaker contacts. Discharge of the springs is prevented only by the ratchet wheel and a holding pawl. One disadvantage of that type of structure has been chipping and breakage of the ratchet wheel teeth particularly during free discharge of springs.

Associated with the foregoing has been a problem of charging a spring by electrically operated means such as a motor, or by manually operated means. The problem has been the use of either means without interference from the other.

SUMMARY OF THE INVENTION

In accordance with this invention, a circuit breaker is provided that comprises a pair of contacts operable between open and closed positions, a crankshaft supported for rotational movement, closing spring means connected to the crankshaft, a ratchet wheel mounted on the crankshaft for advancing the crankshaft, driving connection means between the ratchet wheel and the crankshaft, an oscillating drive wheel coupled with the ratchet wheel and movable between advanced and retracted positions for advancing the ratchet wheel, the ratchet wheel and the drive wheel having reciprocating interengaging parts for advancing the ratchet wheel, a brake wheel rotatably mounted on the drive shaft and the ratchet wheel and the brake wheel having reciprocating interengaging parts for preventing retraction of the ratchet wheel, the brake wheel and the drive wheel being disposed in opposite sides of the ratchet wheel, operating means for advancing the ratchet wheel through the driving connection means to rotate the crankshaft from a spring discharge position to a spring charge position to charge the closing spring means, the closing spring means being dischargeable and upon discharge thereof moving the crankshaft to the spring discharge position to thereby operate the contacts to the closed position, the ratchet wheel, the drive wheel, and brake wheel having reciprocating interengaging parts for preventing retraction of the ratchet wheel, the reciprocating interengaging parts including holes on opposite sides of the ratchet wheel and lateral portions projecting from the drive wheel and the brake wheel and into the holes on corresponding sides of the ratchet wheel, spring means biasing the drive wheel and the brake wheel against the ratchet wheel so as to enable engagement of the lateral portions with the holes, the lateral portions including a strike surface extending from one surface of the brake and drive wheels and an inclined surface extending from said one surface so as to cause the strike surface to engage a hole in the ratchet wheel when the ratchet wheel is advanced the inclined surface of the brake wheel riding out of the hole when the ratchet wheel is advanced, the inclined surface of the drive wheel riding out of the hole against the spring means when the drive wheel is retracted, the operating means including a manual handle structure having a housing surrounding the assembly of the wheels and the drive shaft and having a handle extending from the housing, the operating means also including a motorized drive having an output shaft and a wheel assembling including a motor-driven drive wheel and a driven ratchet wheel, the motor-driven drive wheel being mounted on the output shaft, the driven ratchet wheel being fixedly mounted on the drive shaft, the motor-driven drive wheel and the driven ratchet wheel having the retractable interengaging parts, and the motor-driven drive wheel being biased against the driven ratchet wheel.

The advantage of the device of this invention is that it enables manual charging or electrical charging of stored energy for a circuit breaker without interference from the other. Sliding ratchet plates provide for positive and low-cost means of coupling a motor or manual handle to a drive shaft without any chance of slipping or reversing. Moreover, different strokes can be used for manual charging.

DESCRIPTION OF THE PREFERRED EMBODIMENT

Figure 1:
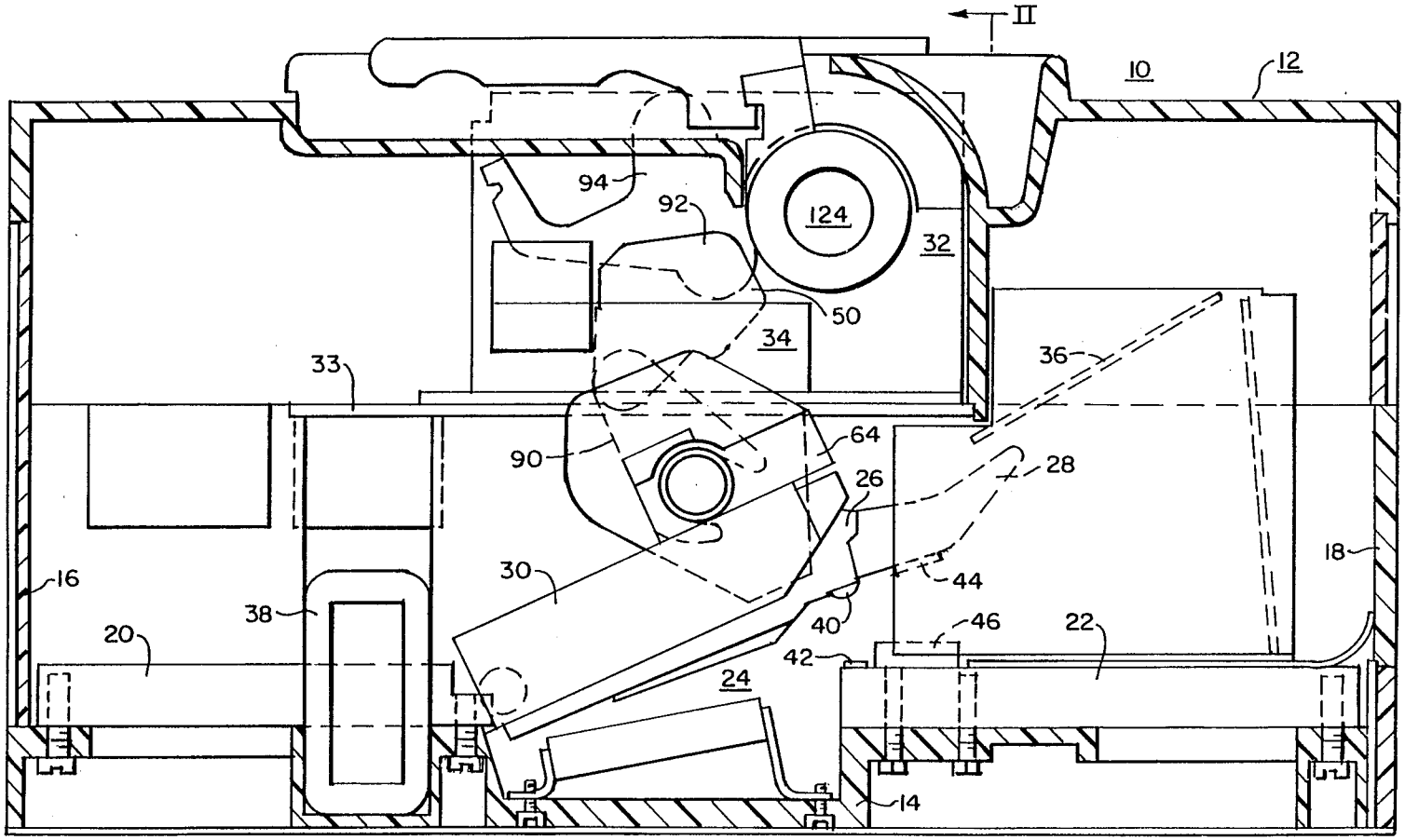
FIG. 1 is a vertical sectional view of a circuit breaker according to the teachings of this invention.
Figure 2:
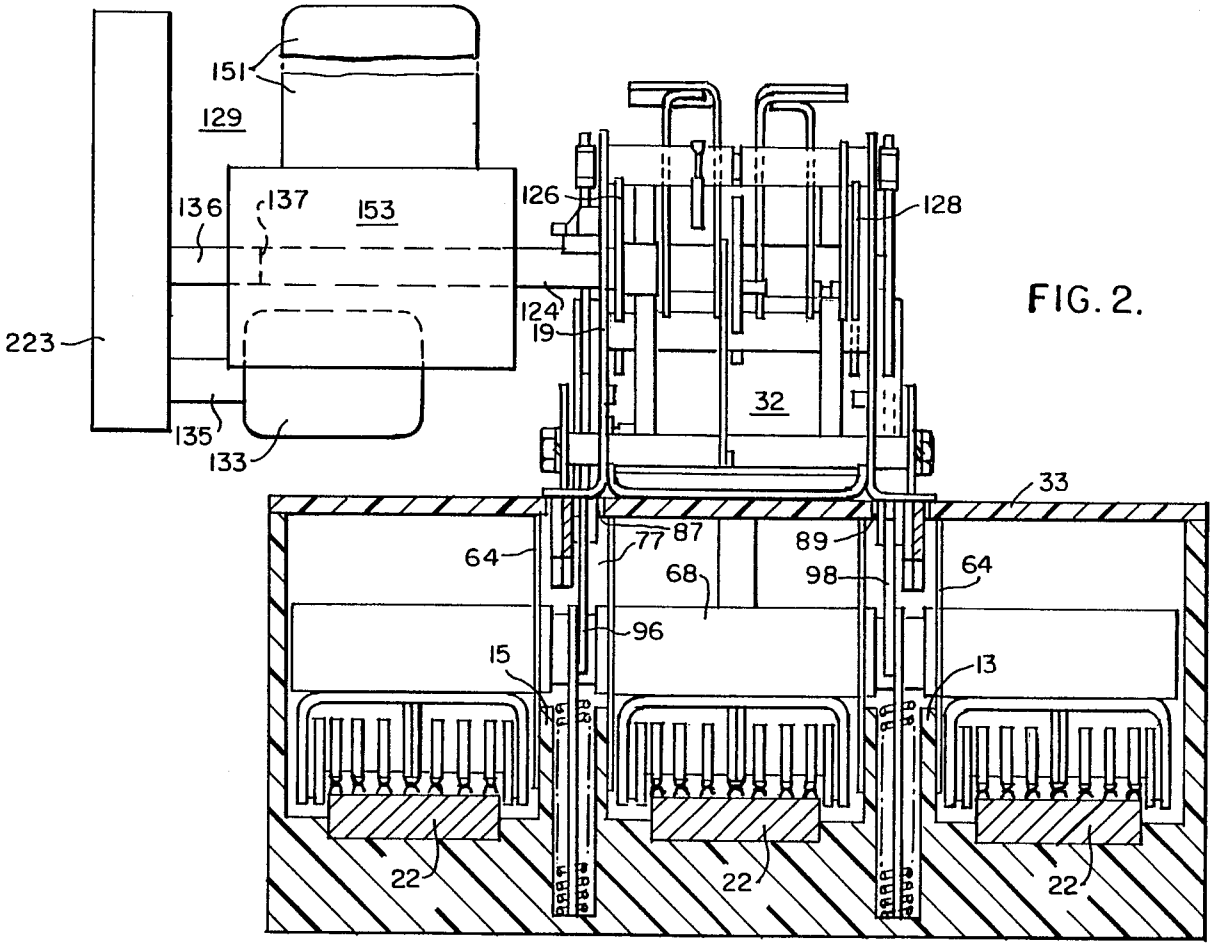
FIG. 2 is a sectional view taken on the line II—II of FIG. 1.

Generally, the circuit breaker disclosed herein is similar to that shown in U.S. Pat. Nos. 4,114,005 and 4,152,561 which are incorporated herein by reference. In FIGS. 1 and 2, a circuit breaker is generally indicated at 10 and includes support 12 which is comprised of a mounting base 14, side walls 16, 18, support walls 13, 15, and a frame structure 19. The mounting base 14 and support walls 13, 15, are, in the preferred embodiment, molded of an electrically insulating material such as plastic.

A pair of stationary contacts 20, 22 are disposed within the circuit breaker with the support walls 13, 15 disposed between adjacent pairs of stationary contacts. Stationary contact 22 would, for example, be connected to an incoming power line (not shown), while the stationary contact 20 would be connected to the load (not shown). Electrically connecting the two stationary contacts 20, 22 is a movable contact structure 24 that comprises a movable contact 26, a movable arcing contact 28, a contact carrier 30, and a crossbar insulator 64. The movable contact 26 and the arcing contact 28 are pivotally secured to the stationary contact 20, and are capable of being in open and closed positions with respect to the stationary contact 22.

The circuit breaker 10 also includes an operating mechanism 32, a toggle means 34, and an arc chute 36 which extinguishes any arc which may occur when the movable contacts 26, 28 change from the closed to open position. A current transformer 38 is utilized to monitor the amount of current flowing through the stationary contact 20.

An insulating barrier 33 insulates the live elements, such as the contacts 26, 28, from the operating mechanism 32 and toggle means 34. The barrier 33 is disposed intermediate the crossbar insulator 64 and the operating mechanism 32 and toggle means 34.

Figure 3:
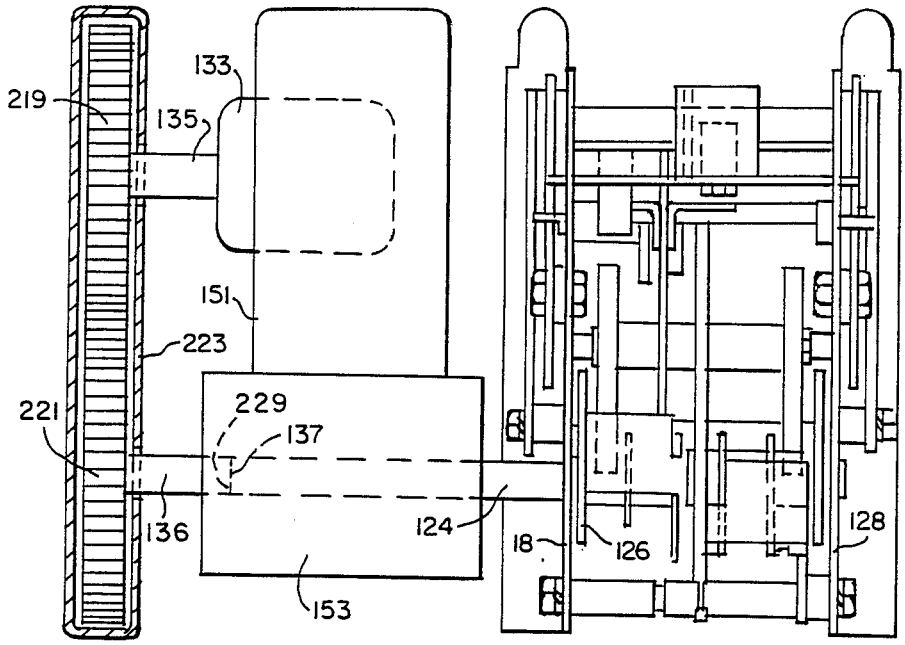
FIG. 3 is a plan view of the mechanism illustrated in FIG. 4.
Figure 4:
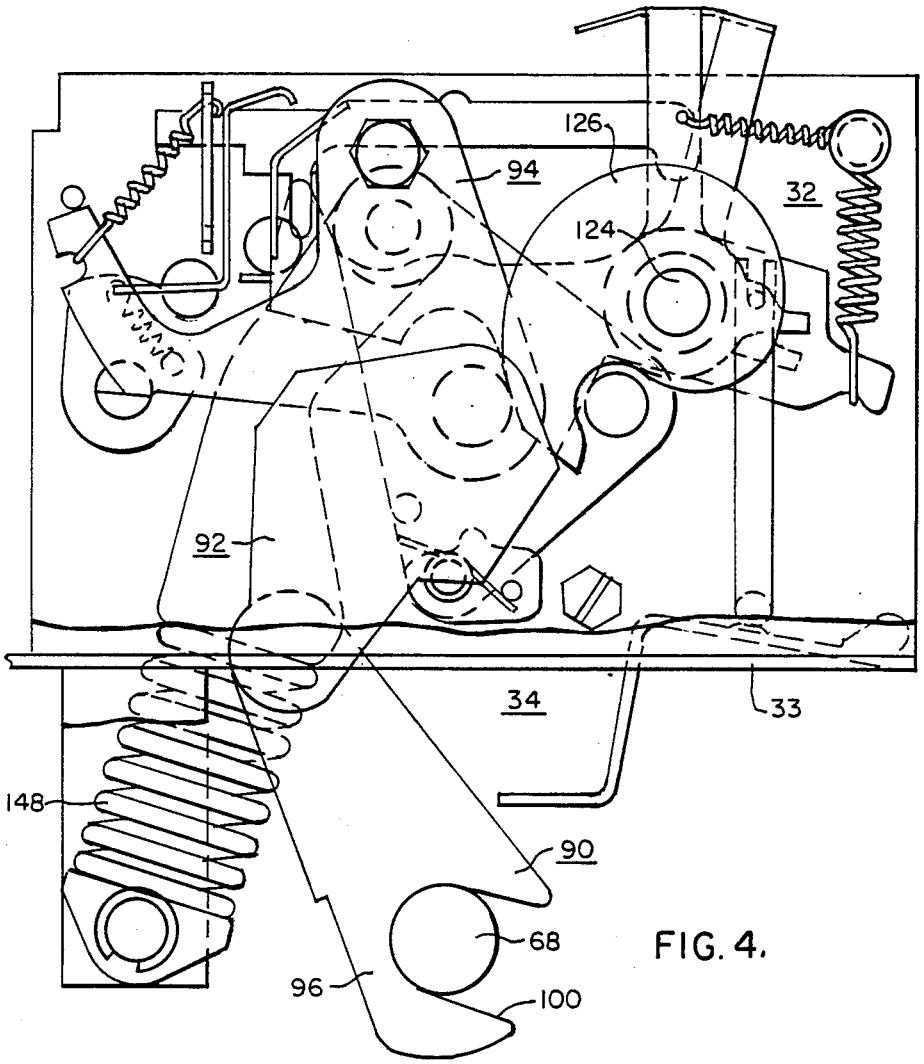
FIG. 4 is a detailed sectional view of the operating mechanism of the circuit breaker in the spring discharge, contact open position.

As shown in FIGS. 2–4, the toggle means 34 and the operating mechanism 32, comprise a first link 90 (FIG. 4), a second link 92, and a toggle lever 94. The first link 90 is comprised of a pair of spaced-apart first link elements 96, 98 (FIG. 2), each of which has a slot 100 therein. The first link elements 96, 98, extend through openings 87, 89, respectively, in the insulating barrier 33, and within openings in the support walls 13, 15. The first link elements 96, 98 and the slot 100 engage the cross arm 68 and provide movement of the cross arm upon the link 90 going into toggle position. The location of the link elements 96, 98 between the crossbar insulators 64 reduces any deflection of the cross arm 68 under high short circuit forces.

Figure 8:
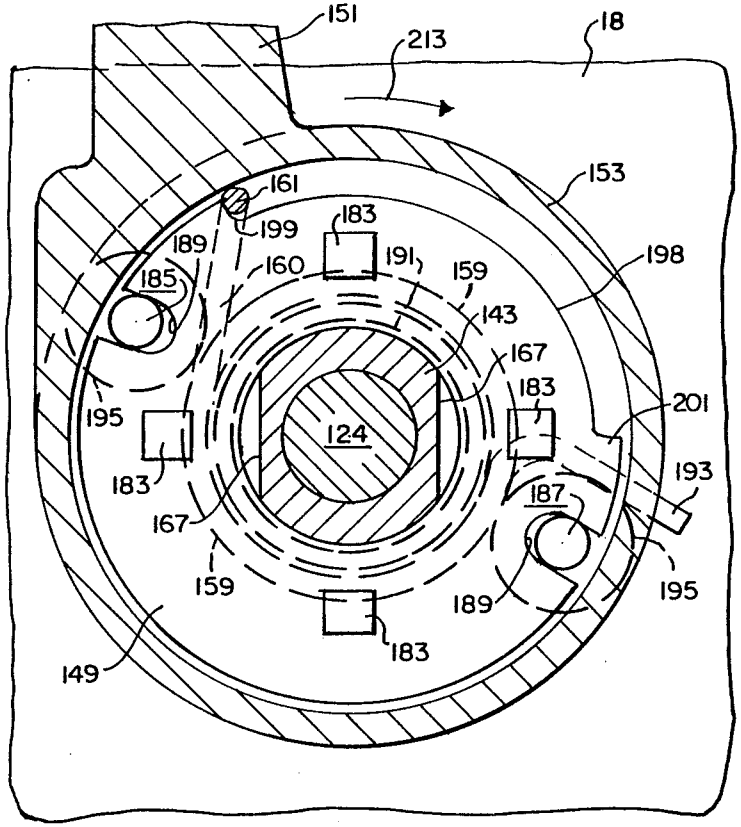
FIG. 8 is a vertical sectional view taken on the line VIII—VIII of FIG. 5.
Figure 9:
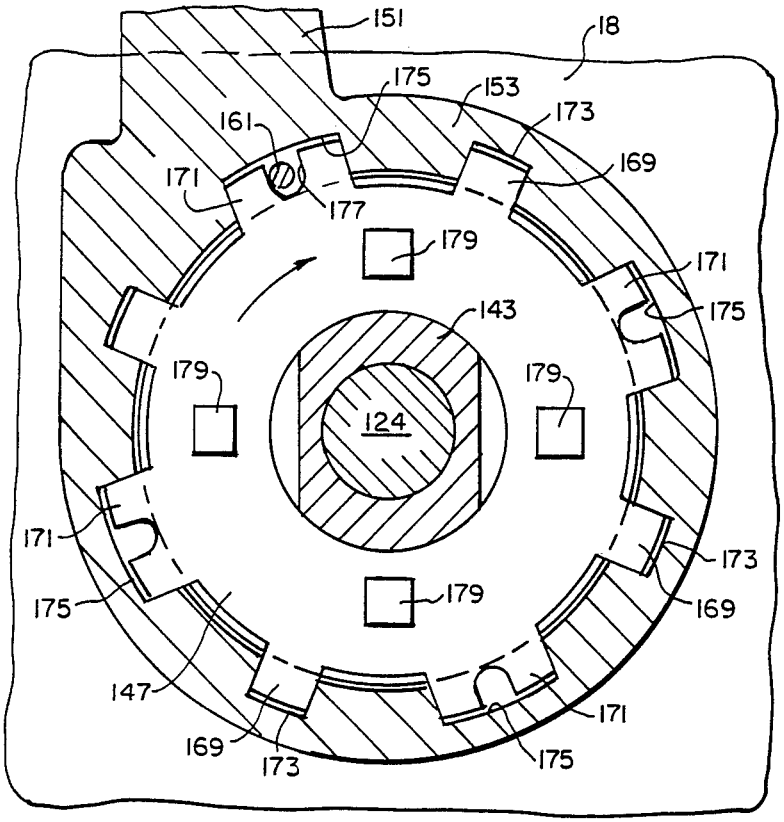
FIG. 9 is a vertical sectional view taken on the line IX—IX of FIG. 5.

The operating mechanism 32 is comprised of a drive shaft 124 having a pair of spaced-apart aligned cams 126, 128 secured thereto. The cams 126, 128 are rotatable with the drive shaft 124 (FIG. 8). Turning means 129 for the drive shaft 124 comprise a drive handle 151 which is secured to the drive shaft 124, and a motor operator 133 having an output shaft 135 which is capable of engaging through gears 219, 221 and shaft 136, the end 137 of the drive shaft 124 to impart rotation thereto.

In accordance with this invention, a ratchet mechanism is provided for manual or electrical charging of stored energy into the circuit breaker. In FIGS. 5–9, a ratchet generally indicated at 141 (FIG. 5) is mounted on the drive shaft or crankshaft 124 which is generally mounted in the side wall 18. The ratchet 141 comprises a sleeve 143, a ratchet wheel 145, a drive wheel 147, brake wheel 149, which wheels are mounted on the sleeve 143. The ratchet 141 also includes the drive handle 151 for manually operating the ratchet, which handle extends from and is integrally mounted on a cylindrical hub 153 having an internal annular flange 155 which is rotatably mounted at 157 on the sleeve 143.

The ratchet 141 also comprises a bias spring 159 having a radial end portion 160 with an out-turned end 161 (FIG. 8) for returning the handle to a retracted position for commencing a charging stroke. The ratchet 141 also includes a coil spring 163 between the flange 155 and the drive wheel 147.

The sleeve 143 is mounted on the crankshaft 124 where it is secured against rotation by a pin 165. The ratchet wheel 145 is keyed on opposite flat surfaces 167 of the sleeve 143 (FIG. 7), whereby rotation of the ratchet wheel 145 causes rotation of the sleeve 143 and the shaft 124.

The drive wheel 147 (FIG. 9) is rotatably mounted on the sleeve 143. It includes radially extending projections 169, 171 which fit into notches 173, 175 of the hub 153, so that the drive wheel rotates with the handle 151 clockwise and counterclockwise. The projections 171 are slightly wider than projections 169 and include opening 177 in one of which openings the spring end 161 is disposed. The drive wheel 147 also includes a plurality of, such as four, lateral extending portions or nibs 179 which project into openings 181 (FIG. 6, 7) of the drive wheel 147.

The spring end 161 occupies one opening 177 (Fig. 9) of the drive wheel 147. However, for ease of assembly and handling a plurality of similar projections 171 with openings 177 are provided. Similarly, although one lateral portion or nib 179 is necessary for the ratchet to function, a plurality of projections and projection-receiving openings 181 (FIG. 7) are provided, thereby facilitating operation of the ratchet.

Figure 5:
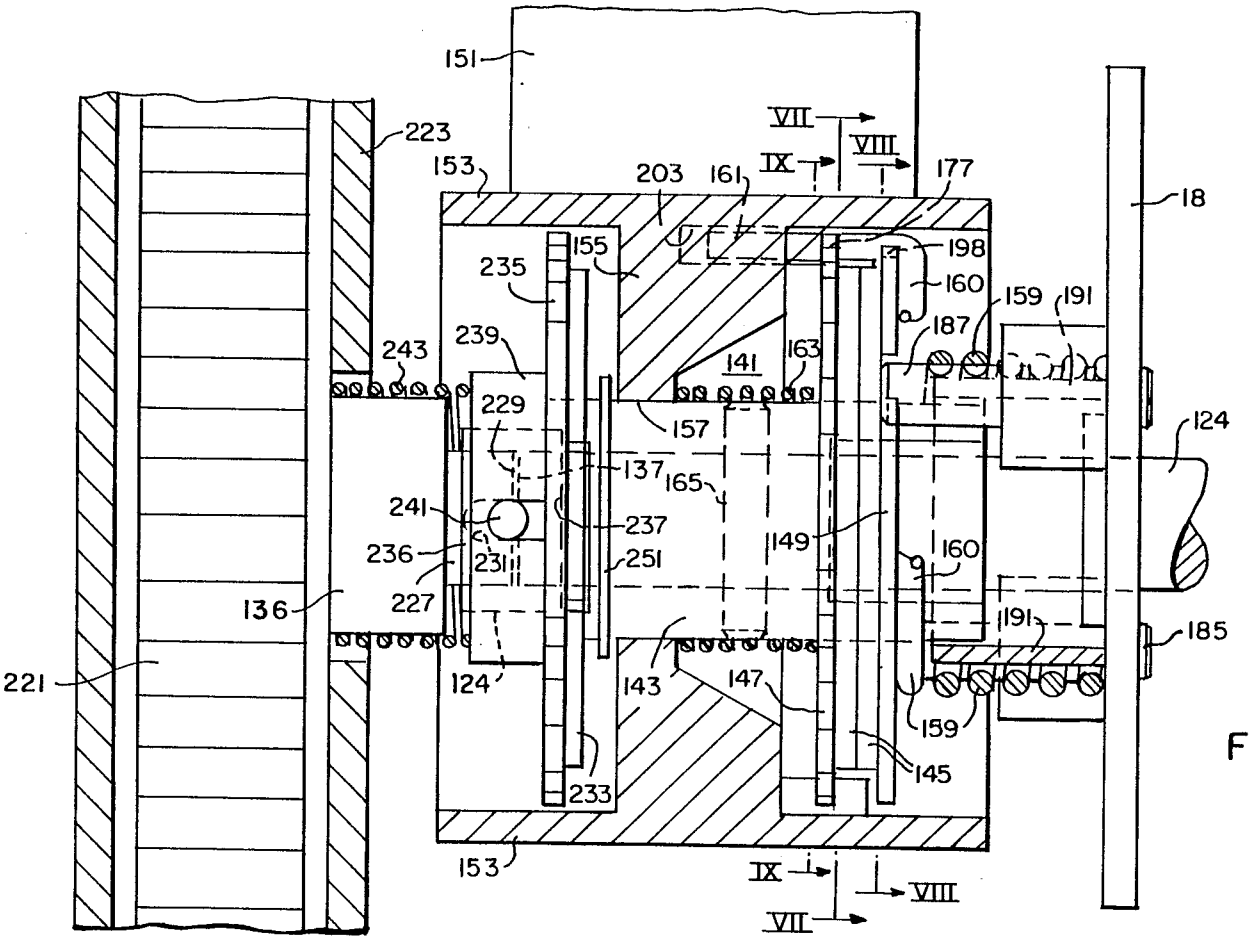
FIG. 5 is a view of the motor and handle ratchet mechanism.
Figure 6:
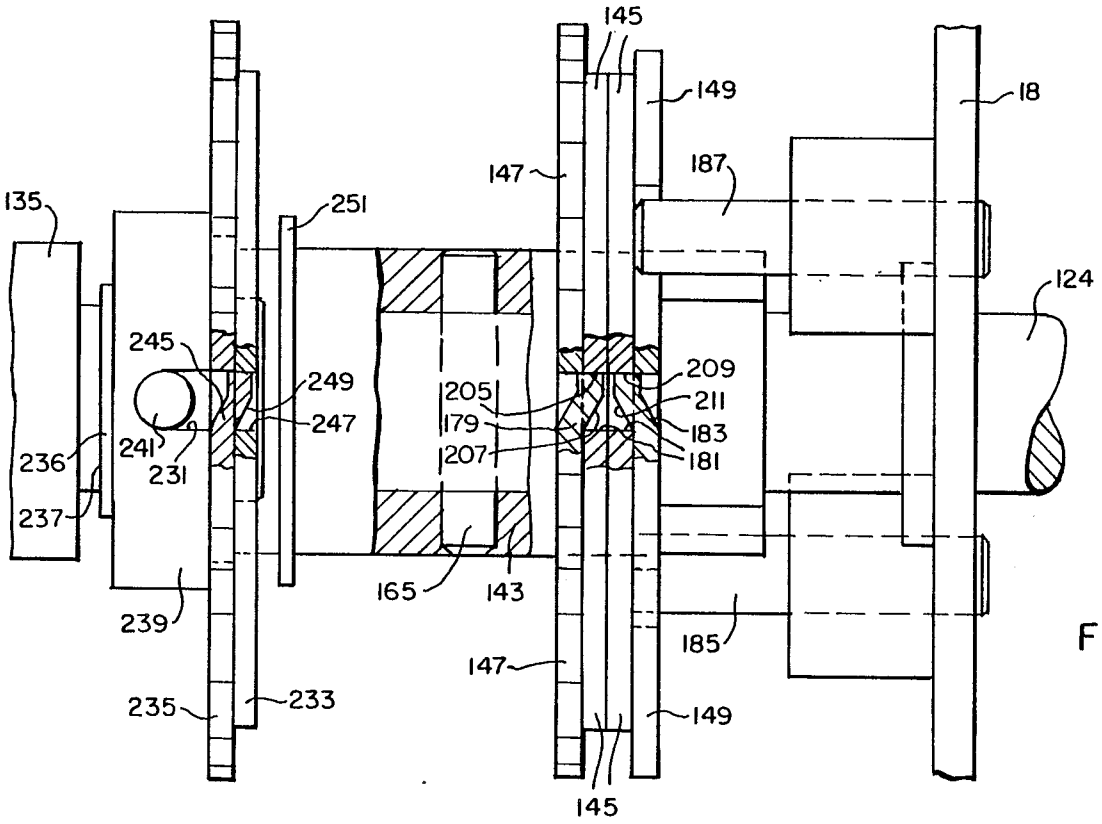
FIG. 6 is an elevational view, partially in section, showing the interfitting lateral portions and receiving holes of adjacent parts.

The brake wheel 149 is disposed on the side of the ratchet wheel 145 opposite that of the drive wheel 147 (FIGS. 5, 6, 8, 9). The brake wheel 149 is rotatably mounted on the sleeve 143 (FIG. 8) and within the hub 153. The brake wheel 149 includes at least one, and preferably four, laterally extending projections or nibs 183 which project into openings 181 of the ratchet wheel 145. As shown in FIGS. 5, 6, a pair of similar ratchet wheels 145 are provided and mounted on the sleeve for rotation together. A pair of ratchet wheels 145 having similar openings 181 for receiving lateral projections 179, 183 may be replaced by a single ratchet wheel having twice the thickness of the ratchet wheels 145 in order to provide openings similar to adjacent openings 181 for receiving lateral extending projections 179, 183 (FIG. 6).

Spring means are provided for biasing the drive wheel 147 and the brake wheel 149 against opposite sides of the ratchet wheel 145. The spring means include the coil spring 163 (FIG. 5) next to the drive wheel 147 and the bias spring 159 next to the brake wheel 149.

A pair of lock pins 185, 187 are mounted on and extend from the side wall 18 and into notches 189 (FIG. 8) of the brake wheel 149 to prevent rotation thereof, but permitting sliding of the plate laterally toward the ratchet wheel 145 under pressure of the coil spring 159. The coil spring 159 is mounted on a cylinder 191 which is mounted on and extends from the side wall 18 to retain the coil spring in place and thereby enable expansion and contraction thereof during operation of the ratchet.

One end portion 193 of the coil spring 159 is anchored on a bearing 195 of the lock pin 187. Another end portion 160 (FIGS. 5, 8) extends from the end of the coil spring adjacent the brake wheel 149 and includes the out-turned end portion 161 which extends substantially parallel to the longitudinal axis of the drive shaft 124.

The brake wheel 149 (FIG. 8) includes a peripheral annular notch 198 having opposite ends 199, 201 through which the spring end 161 moves during operation of the ratchet. The end 161 (FIG. 5) extends through the notch 198 of the brake wheel 149, the opening 177 of the drive wheel 147 and into a slot 203 in the hub 153.

As shown in FIG. 6, each laterally extending portion or nib 179 includes a strike surface 205 and an inclined surface 207. The strike surface engages a side of the opening 181 during charging of the charging spring 148 (FIG. 4). The inclined surface 207 rides over the opposite surface of the notch 181 during return of the drive wheel 149 by the handle 151. Similarly, the laterally extending projection 183 includes a strike surface 209 and an inclined surface 211, the former of which engages one side of the opening 181 of the plate 145 and the inclined surface of which rides over the opposite side of the opening 181.

In operation, the circuit breaker is charged for closing the contacts manually by rotating the handle 151 clockwise in the direction of the arrow 213 (FIG. 8) until the end 161 of the spring strikes the notch end 201. During that action, the notches 173, 175 engaging with projections 169, 171 rotate the drive wheel 147 clockwise, which in turn rotates the ratchet wheel 145 through the laterally extending portions or nibs 179 in the openings 181. The brake wheel 149 retracts against the coil spring 159 as the edge of the opening 181 rides over the inclined surface 211 of the laterally extending portion or nib 183. At the end of a given stroke of the handle 151, the coil spring 159 through the end portion 161 returns the handle 151 to the original position (FIG. 8) in preparation for a second charging stroke.

During rotation, the laterally extending portion 183 of the brake wheel 149 is lodged in an opening 181 to prevent retraction of the ratchet wheel 145. Simultaneously, the return action of the handle 151 rotates the drive wheel 147 through notches 173, 175 and projections 169, 171 counterclockwise, causing the inclined surfaces 207 to ride over the edge of the opening 181 against the pressure of the spring 163. At the end of the return stroke of handle 151, each laterally extending projection of nib 207 is lodged in another opening 181 ready for a second charging stroke of the handle 151 as set forth above. Use of the handle to charge the circuit breaker mechanism may employ 30°, 60° or 90° strokes for the charging. Accordingly, the charging spring 148 is completely charged for closing the contacts in a minimum of four strokes of the manual handle 151.

Figure 7:
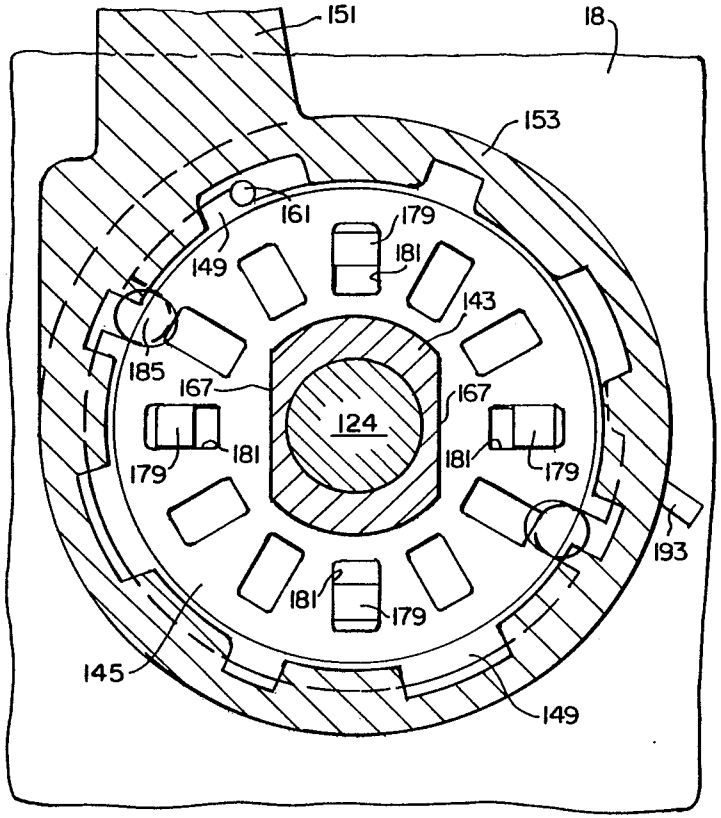
FIG. 7 is a vertical sectional view taken on the line VII—VII of FIG. 5.
Figure 10:
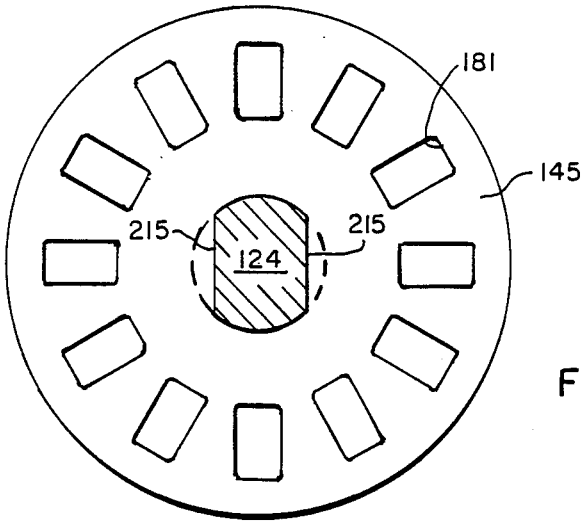
FIG. 10 is a vertical sectional view of another embodiment.

Another embodiment of the invention is shown in FIG. 10 in which similar numerals refer to similar parts. Under some circumstances, such as a reduced force of the charging spring, the sleeve 143 may not be required. In such event, the drive shaft 124 is provided with similar flat surfaces 215, with a corresponding change in the opening of the ratchet wheel 145 for enabling keyed mounting of the wheel upon the shaft. Thus, driving connection means between the ratchet wheel and the crankshaft is provided either by the ratchet wheel being mounted directly upon the shaft (FIG. 10), or by the sleeve 143 (FIG. 7).

Use of the handle 151 comprises manual operating means for advancing the ratchet wheel through the driving connection means to rotate the crankshaft from a spring discharged position to a spring charged position to charge the closing spring means.

The operating means for advancing the ratchet wheel may also include a motorized mechanism including the motor 133 (FIG. 3) which is connected, for a simplified example, to a pair of cooperating gears 219, 221, within the gearbox 223 for operating the output shaft 136. The output shaft 136 includes a reduced portion 227 (FIG. 5) which terminates at a surface 229 (FIG. 5) and which includes a slot 231.

Driving connection between the shaft 136 and the crankshaft 124 is provided by a ratchet wheel 233 (FIG. 5) and a drive wheel 235 which are substantially similar to the ratchet 145 and drive wheel 147. The ratchet wheel 233 is fixedly mounted on a sleeve 236 which has an end surface 237.

The drive wheel 235 includes a hub 239 which is slidably mounted on the reduced shaft portion 227 by means of a mounting pin 241 which is slidable within the slot 231. A coil spring 243 biases the drive wheel 235 against the ratchet wheel 233. In this manner, a laterally extending projection or nib 245 (FIG. 6) extends into an opening 247 in the ratchet wheel 233. In this manner, the motor 133 rotates the ratchet wheel 233 through the reciprocating interengaging parts or projection 245 and opening 247 for rotating the crankshaft 124 and charging the spring within the circuit breaker. The coil spring retains the lateral projections 245 and opening 247 in oscillating engagement. When the spring is fully charged and the motor 217 is de-energized, the brake wheel 149 retains the crankshaft 124 in place.

It is pointed out that when the handle 151 is used for charging the spring, the ratchet wheel 233 (FIG. 6) rotates while the drive wheel 235 remains constant, whereby an inclined surface 249 on the projection 245 rides over the edge of the opening 247, causing the coil spring 243 to contract each time the lateral portion 245 moves out of successive openings 247. A retaining ring 251 (FIG. 5) prevents the handle assembly from moving rightward.

Figure 11:
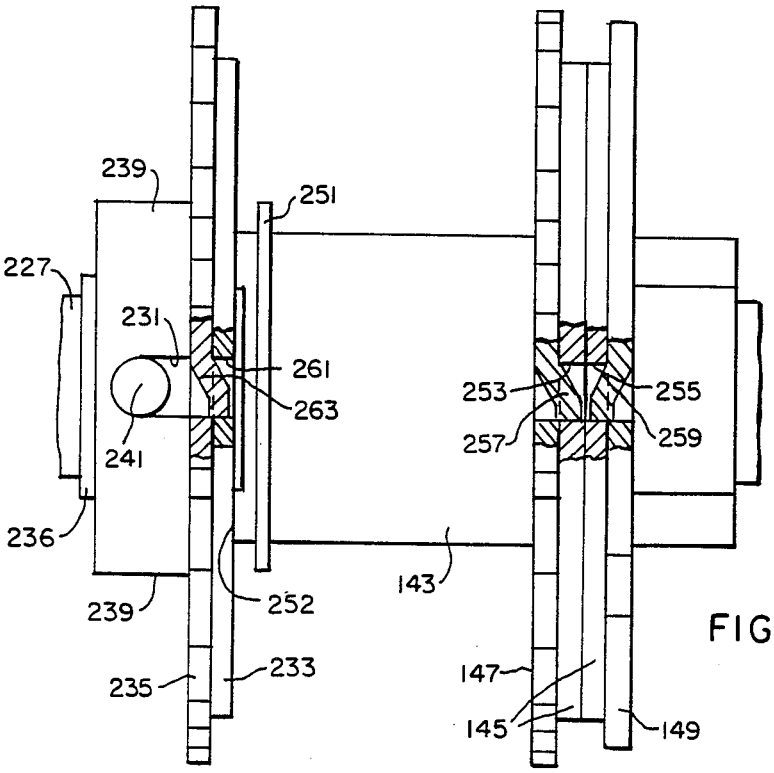
FIG. 11 is a detailed view of another embodiment of the invention.

Another embodiment of the invention is shown in FIG. 11 in which similar numerals refer to similar parts. The drive wheel 147 includes an opening 253 and the brake wheel 149 includes openings 255. The ratchet wheels 145 are each provided with laterally extending projections 257, 259 which engage the openings 253, 255, respectively, for charging of the closing springs of the circuit breaker. Likewise, the drive wheel 235 is provided with openings 261 into which projections 263 from the ratchet wheel 233 extend. The wheel 233 is prevented from moving leftward by surface 252 on sleeve 143.

In conclusion, the device of this invention enables manual charging or electrical charging of stored energy for a circuit breaker or a switch. Either means can be used without interference from the other. The sliding ratchet plates provide positive and low cost means of coupling a motor or a manual handle to a shaft without any chance of slipping or reversing. Different strokes can be used for manual charging.

What is claimed is:

1. A circuit breaker comprising:

a pair of contacts operable between open and closed positions;

a crankshaft supported for rotational movement;

closing spring means connected to the crankshaft;

a ratchet wheel mounted on the crankshaft for advancing the crankshaft;

driving connection means between the ratchet wheel and the crankshaft;

an oscillating drive wheel coupled with the ratchet wheel and movable between advanced and retracted positions for advancing the ratchet wheel;

the ratchet wheel and the drive wheel having reciprocating interengaging parts for advancing the ratchet wheel;

brake means coupled with the crankshaft to prevent retraction of the crankshaft when the drive wheel is retracted;

operating means for advancing the ratchet wheel through the driving connection means to rotate the crankshaft from a spring discharged position to a spring charged position to charge the closing spring means;

the closing spring means being dischargeable to actuate the contacts to the closed position;

spring means biasing the drive wheel against the ratchet wheel whereby to engage the reciprocating interengaging parts when the operating means is advanced and enable disengagement of said parts when the operating means is retracted;

the brake means including a brake wheel mounted on the drive shaft and the ratchet wheel and brake wheel having reciprocating interengaging parts for preventing rotation of the crankshaft;

the brake wheel and the drive wheel being disposed in opposite sides of the ratchet wheel;

the operating means including a manual handle structure having a housing surrounding the assembly of the wheels and drive shaft and having a handle extending from the housing;

the operating means includes a motorized drive having an output shaft and a wheel assembly including a motor driven drive wheel and a driven ratchet wheel;

the reciprocating interengaging parts including a first lateral portion projecting from one side of one of the drive wheel and the ratchet wheel and a lateral-portion receiving hole in the other of the drive wheel and ratchet wheel, a second lateral portion projecting from one side of one of the brake wheel and the ratchet wheel and a second lateral-portion receiving hole in the other of the brake wheel and the ratchet wheel, and spring means biasing the drive wheel and brake wheel against the ratchet wheel so as to enable engagement of the lateral-portions with the holes.

2. The circuit breaker of claim 1 in which the spring means comprises a first coil spring on the drive shaft urging the drive wheel against the ratchet wheel, and comprises a second coil spring on the drive shaft urging the brake wheel against the ratchet wheel.

3. The circuit breaker of claim 2 in which one of the first and second coil springs includes an end portion attached to the housing and the drive wheel is attached to the end portion so as to rotate the drive wheel when the manual handle structure is rotated.

4. The circuit breaker of claim 3 in which each lateral-portion includes a strike surface extending from one surface of the wheel and an inclined surface extending from said one surface, whereby the strike surface engages a corresponding surface in the ratchet wheel when the wheel is rotated in one direction and the inclined surface rides out of the holes when the wheel is rotated in the other direction.

* * * * *